United States Patent [19]

Collins

[11] 4,272,700

[45] Jun. 9, 1981

[54] ONE PIECE ASTIGMATIC GRID FOR COLOR PICTURE TUBE ELECTRON GUN AND METHOD OF MAKING SAME

[75] Inventor: Floyd K. Collins, Seneca Falls, N.Y.

[73] Assignee: GTE Products Corporation, Stamford, Conn.

[21] Appl. No.: 94,409

[22] Filed: Nov. 15, 1979

[51] Int. Cl.[3] ..... H01J 29/46

[52] U.S. Cl. ..... 313/458; 29/25.17

[58] Field of Search ..... 313/458, 447, 412, 414; 29/25.17, 25.18

[56] References Cited

U.S. PATENT DOCUMENTS 3,363,136 1/1968 Pakswer ..... 313/447 X

*Primary Examiner*—James B. Mullins
*Assistant Examiner*—Darwin R. Hostetter
*Attorney, Agent, or Firm*—William H. McNeill

[57] ABSTRACT

A one-piece control grid for functioning as an astigmatic lens in an electron gun has an arcuate slot formed in the face of the grid. A suitable beam aperture is provided at the bottom of the slot.

6 Claims, 4 Drawing Figures

ONE PIECE ASTIGMATIC GRID FOR COLOR PICTURE TUBE ELECTRON GUN AND METHOD OF MAKING SAME

TECHNICAL FIELD

This invention relates to electron guns for color television picture tubes and more particularly to astigmatic grids therefor and to a method of making such grids.

BACKGROUND OF THE INVENTION

The use of astigmatic electron lenses in electron guns is known. Generally, the lenses form a noncircular electron beam bundle, usually elliptical in cross-section. Exemplary lenses of this general description are shown in U.S. Pat. Nos. 3,852,608; 3,866,081; 3,873,878; 4,143,293; and in FIGS. 1 and 2 of the instant specification. These prior art lenses are complicated and expensive to make and require either a two part grid or cooperation between two or more grids.

DISCLOSURE OF THE INVENTION

It is therefore an object of this invention to provide an astigmatic lens employing a one piece grid that is economical to fabricate and one that obviates the disadvantages of the prior art.

It is another object of the invention to provide a method of making such a grid.

The objects are accomplished in one aspect of the invention by the provision of such a grid which has a functional grid area defined by a given perimeter and having a given thickness. A two part lens forming aperture is formed in the functional grid area. A first part of the aperture comprises a slot having a length greater than its width and a maximum depth less than the given thickness. The second part comprises a symmetrical aperture located at the maximum depth and extending through the remaining portion of the thickness.

The slot is formed by contacting the face of the functional grid area with a rotating, metal removing wheel.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
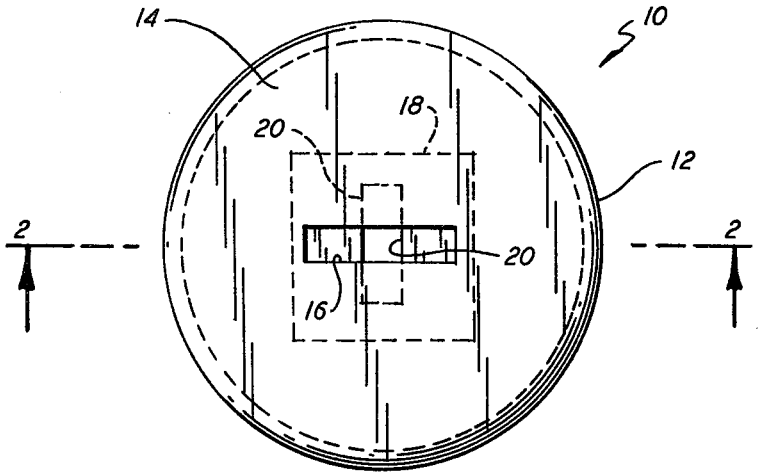
FIG. 1 Prior Art
FIG. 1 is a plan view of one form of prior art astigmatic lens.
Figure 2:
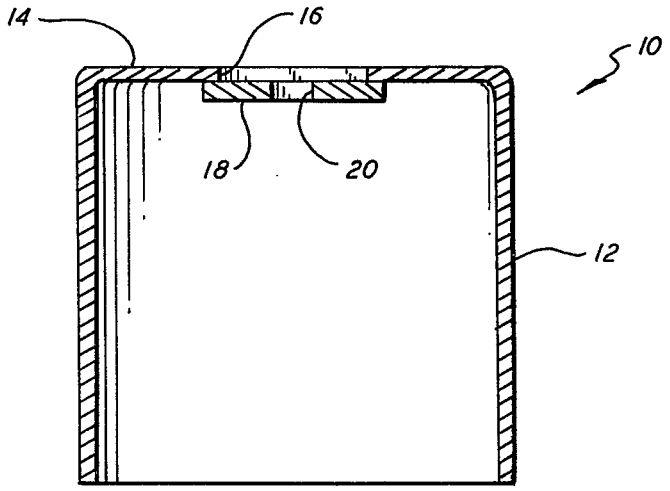
FIG. 2 Prior Art
FIG. 2 is a sectional view taken along the line 2—2 of FIG. 1.

Referring now to the drawings with greater particularity there is shown in FIG. 1 a plan view of a prior art astigmatic lens formed in the $G_1$ or control grid 10 of an electron gun. Grid 10 in this invention is a cup-shaped structure having a peripheral wall 12 and a functional grid area 14. This area 14 is provided with an elongated rectangular aperture 16. A second grid element 18 is provided with a similar elongated rectangular aperture 20, which latter aperture is positioned in orthogonal relation to aperture 16. Grid element 18 is welded to the underside of functional area 14 to maintain its position. When viewed in plan this construction shows a substantially square aperture leading into a rectangular slot. The shape of the aperture and slot function as an astigmatic lens in a finished electron gun, as is known in the art. The problems with this construction are its expense, the difficulty of keeping proper alignment between the two slots and the fact that the weld areas can cause raised portions which affect the $G_1$–$G_2$ spacing and degrade the desired focus characteristics.

Figure 3:
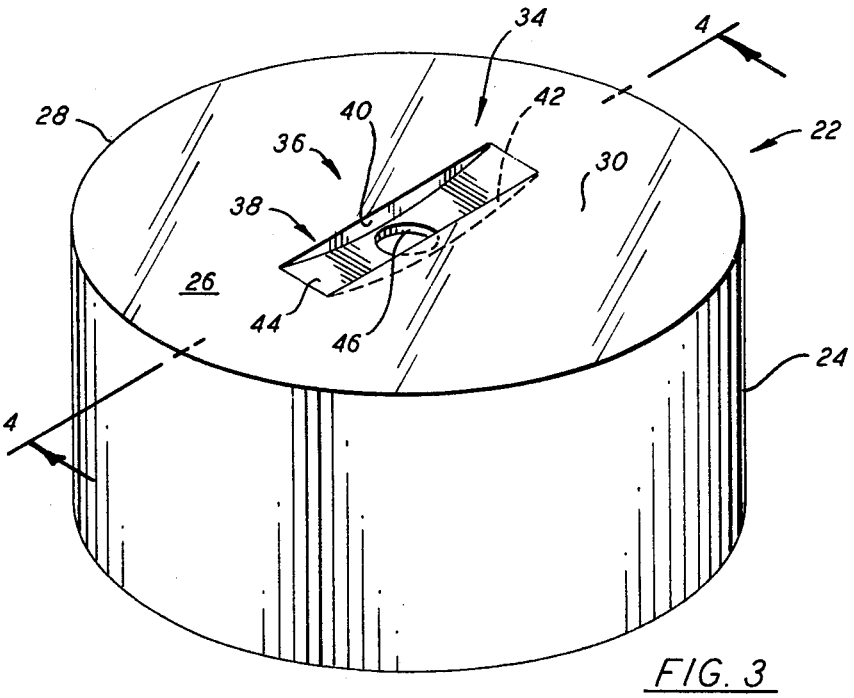
FIG. 3 is a perspective view of the grid and lens of the invention.
Figure 4:
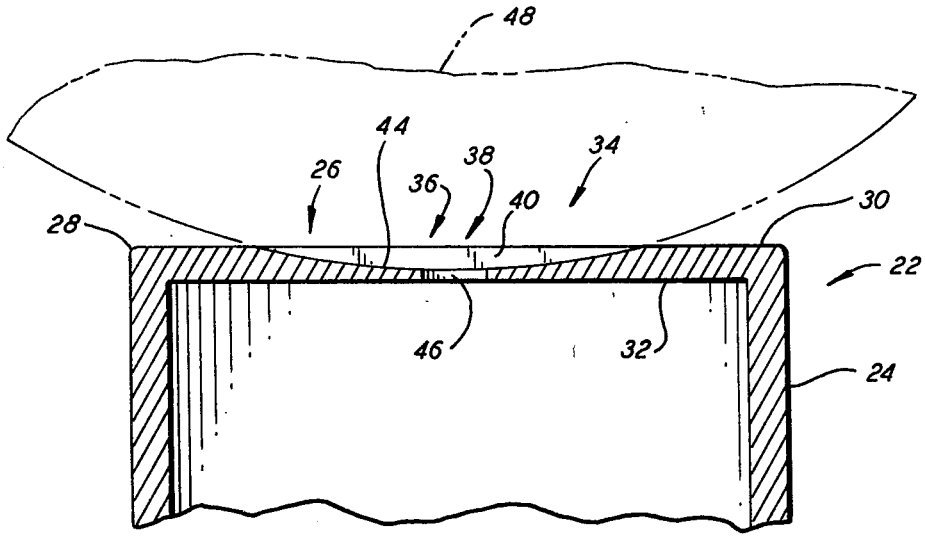
FIG. 4 is a sectional view taken along the line 4—4 of FIG. 3.

To obviate these problems there is provided the one-piece structure of FIG. 3. Therein is shown a grid 22 having a side wall 24 and a functional grid area 26. The functional grid area 26 is defined by a given perimeter 28, which in this instance is circular, and an upper surface or face 30 and a lower surface 32 which define therebetween a given thickness. A two part lens 34 is formed in grid area 26 and comprises a first part 36 in the form of a slot 38 having a length greater than its width and a depth less than that of the thickness between surfaces 30 and 32. Slot 38 has side walls 40 and 42 which can be parallel and an arcuate bottom 44. The depth of slot 38 thus varies from nothing at the edges to a maximum depth at the center. The second part comprises a through aperture 46 located at the maximum depth of slot 38 and penetrating the remaining thickness.

Slot 38 is preferably formed by contacting surface 30 with a rotating, metal removing wheel, shown in phantom at 48. Such a wheel can be a grinding stone or saw blade and preferably has a thickness equal to the width of slot 38. This procedure allows accurate control of the depth of slot 38, which, in turn, allows accurate control of the cut-off and beam spot quality.

Aperture 46 can be provided by any suitable technique such as boring or punching.

This one-piece construction provides unique advantages over the complex prior art structures, particularly in its inexpensive construction and the control of the flatness of its operating surfaces.

While there have been shown what are at present considered to be the preferred forms of the invention, it will be apparent to those skilled in the art that various changes and modifications can be made herein without departing from the scope of the invention as defined by the appended claims.

I claim:

1. A one-piece grid which provides an astigmatic lens for a cathode ray tube electron gun comprising: a functional grid area defined by a given perimeter and having a given thickness; and a two part lens forming aperture formed in said functional grid area; a first part of said aperture comprising a slot having a length greater than its width and a maximum depth less than said given thickness; and a second part comprising an aperture located at said maximum depth and extending through the remaining portion of said thickness.

2. The grid of claim 1 wherein the bottom of said slot is arcuate.

3. The grid of claim 2 wherein the side walls of said slot are parallel.

4. In a method of making a one-piece grid which provides an astigmatic lens for a cathode ray tube electron gun the steps comprising: forming a pre-grid having a functional grid area defined by a given perimeter and having a given thickness; providing an arcuate slot in the face of said functional grid area, said slot having a maximum depth less than said given thickness; and forming an aperture in said slot at said maximum depth, said aperture penetrating the remaining part of said thickness.

5. The method of claim 4 wherein said arcuate slot is formed by contacting the face of said functional grid area with a rotating, metal removing wheel.

6. The method of claim 5 wherein said wheel has a thickness equal to the width of said slot.

* * * * *